US009868014B1

(12) United States Patent
Lake

(10) Patent No.: US 9,868,014 B1
(45) Date of Patent: Jan. 16, 2018

(54) ANKLE HARNESS FOR SECURING A FREE WEIGHT

(71) Applicant: Virginia Batiz Lake, Round Rock, TX (US)

(72) Inventor: Virginia Batiz Lake, Round Rock, TX (US)

( * ) Notice: Subject to any disclaimer, the term of this patent is extended or adjusted under 35 U.S.C. 154(b) by 29 days.

(21) Appl. No.: 15/222,344

(22) Filed: Jul. 28, 2016

Related U.S. Application Data

(60) Provisional application No. 62/198,576, filed on Jul. 29, 2015.

(51) Int. Cl.
*A63B 21/00* (2006.01)
*A63B 21/065* (2006.01)
*A63B 21/072* (2006.01)

(52) U.S. Cl.
CPC ..... *A63B 21/065* (2013.01); *A63B 21/0726* (2013.01); *A63B 21/4034* (2015.10); *A63B 21/4043* (2015.10)

(58) Field of Classification Search
CPC ..... A63B 21/0004; A63B 21/00043; A63B 21/00058; A63B 21/00061; A63B 21/00065; A63B 21/00069; A63B 21/00072; A63B 21/00185; A63B 21/065; A63B 21/068; A63B 21/072; A63B 21/0722; A63B 21/0724; A63B 21/0726; A63B 21/0728; A63B 21/075; A63B 21/08; A63B 21/15; A63B 21/159; A63B 21/40; A63B 21/4001; A63B 21/4011; A63B 21/4013; A63B 21/4015; A63B 21/4023; A63B 21/4025; A63B 21/4027; A63B 21/4033; A63B 21/4034; A63B 21/4039; A63B 21/4043; A63B 23/04; A63B 23/0405; A63B 23/0482; A63B 23/0494; A63B 23/085; A63B 23/08; A63B 23/10; A63B 69/0057; A63B 69/0059; A63B 2069/0062; A63B 71/0054; A63B 2071/0072; A63B 2209/00; A63B 2209/10; A63B 2225/09; A63B 2225/093
See application file for complete search history.

(56) References Cited

U.S. PATENT DOCUMENTS 1,717,609 A * 6/1929 Ludwig ..... A61F 13/066 602/66
2,214,052 A * 9/1940 Good ..... A63B 21/065 36/132

(Continued)

*Primary Examiner* — Loan H Thanh
*Assistant Examiner* — Gary D Urbiel Goldner
(74) *Attorney, Agent, or Firm* — Mark H. Plager

(57) ABSTRACT

An ankle harness for securing a free weight to a shoe and an ankle region of a user, the ankle harness including a pad member having a top face, a bottom face, a top edge, a bottom edge, and a pair of side edges, the top face of the pad member having a first fastener, an ankle strap coupled to one of the pair of side edges and having a top face and a bottom face, the bottom face of the ankle strap having a second fastener, a first pair of straps coupled to the pad member and extending past the bottom edge of the pad member, and a second pair of straps coupled to the pad member and extending past the bottom edge of the pad member. The pad member is secured to the user by disposing the ankle strap around the ankle region to permit the second fastener to engage with the first fastener.

6 Claims, 4 Drawing Sheets

(56) References Cited

U.S. PATENT DOCUMENTS 2,723,663 A * 11/1955 Davis ..... A61F 5/04 128/DIG. 23
3,278,184 A * 10/1966 Rosenbaum ..... A63B 21/065 473/59
3,334,898 A * 8/1967 McCrory ..... A63B 21/065 36/132
3,383,708 A * 5/1968 Pappas ..... A61F 13/066 128/DIG. 15
3,582,067 A * 6/1971 Rucks ..... A63C 3/00 280/816
3,612,046 A * 10/1971 Gaylord, Jr. ..... A61H 1/0218 128/DIG. 15
3,618,598 A * 11/1971 Davis ..... A61F 5/0585 602/27
3,680,551 A * 8/1972 Bell ..... A61F 5/04 602/36
3,720,206 A * 3/1973 Walker ..... A61F 13/066 132/902
3,910,577 A * 10/1975 Boyle ..... A63B 21/065 482/105
3,978,853 A * 9/1976 Morrison ..... A61F 5/04 602/36
4,322,072 A * 3/1982 White ..... A63B 21/065 482/105
4,355,801 A * 10/1982 Thomsen ..... A63B 21/065 482/105
4,565,370 A * 1/1986 Christianson ..... A61H 1/0218 482/144
4,700,943 A * 10/1987 Widinski ..... A61F 7/02 482/105
4,753,229 A * 6/1988 Sutherland ..... A61F 13/066 602/27
5,169,364 A * 12/1992 Donaldson ..... A63B 21/065 482/105
5,542,896 A * 8/1996 Qaiesi ..... A43B 19/005 482/105
5,632,709 A * 5/1997 Walsh ..... A43B 3/0078 36/136
5,683,335 A * 11/1997 Groves ..... A43B 19/005 482/105
7,171,766 B2 * 2/2007 Bouche ..... A43B 1/0081 36/89
D627,892 S * 11/2010 Terrio ..... D24/188
2008/0248932 A1 * 10/2008 Geritano ..... A63B 21/065 482/105
2010/0050477 A1 * 3/2010 Zeek ..... A43B 5/00 36/132
2010/0261583 A1 * 10/2010 Ferguson ..... A63B 21/151 482/79
2011/0092342 A1 * 4/2011 Blank ..... A63B 21/065 482/93
2012/0028767 A1 * 2/2012 Zeek ..... A63B 21/065 482/105
2012/0088640 A1 * 4/2012 Wissink ..... A63B 21/0726 482/110
2012/0100967 A1 * 4/2012 Leibowitz ..... A63B 21/0023 482/124
2013/0316604 A1 * 11/2013 Burdick ..... A63B 31/11 441/64
2016/0029742 A1 * 2/2016 Cifo Garcia ..... A43B 19/005 36/132

* cited by examiner

ANKLE HARNESS FOR SECURING A FREE WEIGHT

RELATED APPLICATION

The application claims priority to provisional patent application U.S. Ser. No. 62/198,576 filed on Jul. 29, 2015, the entire contents of which is herein incorporated by reference.

BACKGROUND

The embodiments herein relate generally to exercise equipment designed to strengthen and develop the user's lower body region.

It is desirable to use free weights such as dumbbells for lower body and leg training workouts. Currently, individuals typically have to use large equipment in locations such as gyms to train their lower body and legs. This equipment is undesirable because they are bulky, expensive and not portable. Alternatively, there exist wraps used to secure weighted objects to a user's legs. However, these wraps require the use of specialized sets of weighted objects, which can be expensive to replace and a burden to transport.

As such, there is a need in the industry for an ankle harness for use in securing a conventional and readily available free weight such as a dumbbell to the user's ankle region, which helps the user to effectively train his/her lower body. In addition, there is a need for the ankle harness to be small, portable and light weight, thereby making it easy to carry, pack and use anywhere.

SUMMARY

An ankle harness for securing a free weight to a shoe and an ankle region of a user to permit the user to perform strength exercises is provided. The ankle harness comprises a pad member comprising a top face, a bottom face, a top edge, a bottom edge opposite the top edge, and side edges connecting the top and bottom edges, the top face of the pad member comprising a first fastener coupled thereto, an ankle strap coupled to one of the pair of side edges and comprising a top face and a bottom face, the bottom face of the ankle strap comprising a second fastener coupled thereto, a first pair of straps coupled to the pad member and extending past the bottom edge of the pad member, and a second pair of straps coupled to the pad member and extending past the bottom edge of the pad member, wherein the pad member is secured to the user by disposing the ankle strap around the ankle region to permit the second fastener of the strap to engage with the first fastener of the pad member, wherein the first pair of straps is configured to wrap around the free weight and ankle portion of the user, wherein the second pair of straps is configured to wrap around the free weight and shoe. In certain embodiments, a lace is coupled to the end of each strap in the first and second pairs of straps.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
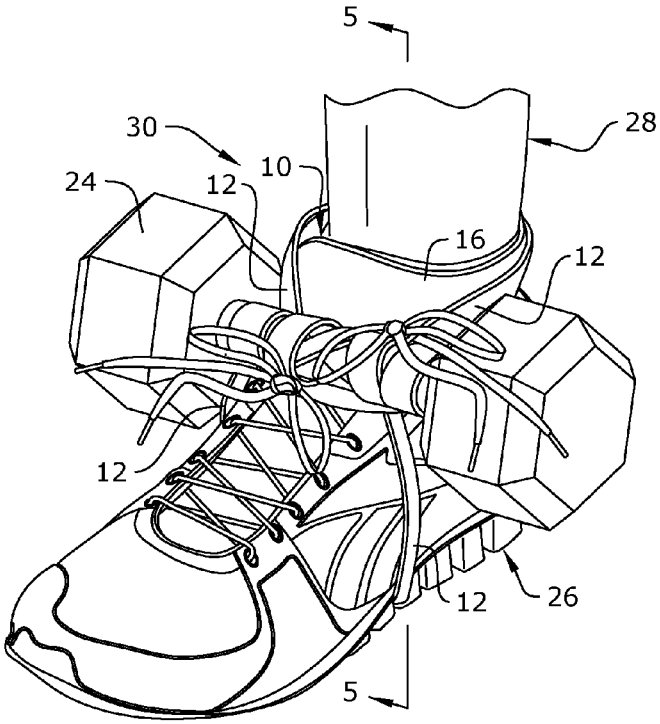
FIG. 1 depicts a perspective view of certain embodiments of the ankle harness shown in use.

As depicted in FIGS. 1-4, ankle harness 10 is configured to secure weighted object 24 to ankle region 30 of operator 28 and shoe 26. In this configuration, operator 28 can perform a variety of exercises with weighted object 24 to help develop and strengthen the operator's legs and lower body region. In a preferred embodiment, weighted object 24 is a dumbbell or other similar barbell type of weight having a metal bar with weights attached to opposing ends of the bar. Ankle harness 10 generally comprises ankle strap 16, ankle pad 20, straps 12 and laces 14.

In a preferred embodiment, ankle pad 20 comprises a generally trapezoidal-shaped member comprising a top edge and a bottom edge oriented parallel to one another, and slanted side edges connecting the top and bottom edges. Ankle strap 16 is coupled to one of the side edges of ankle pad 20 and comprises strap fastener 18 sewn to the bottom face of ankle strap 16. Ankle pad 20 comprises pad fastener 22 sewn to a top face of the pad. In a preferred embodiment, strap fastener 18 and pad fastener 22 comprise hook fasteners and corresponding loop fasteners, or vice versa. However, alternative fasteners known in the field may be used instead such as snap components or the like.

In one embodiment, ankle strap 16 and ankle pad 20 comprise a single member. However, in alternative embodiments, ankle strap 16 and ankle pad 20 may be distinct components coupled together. Ankle strap 16 and ankle pad 20 may be made from various materials including, but not limited to, leather, suede, other fabrics, or the like.

A plurality of straps 12 is sewn to ankle pad 20 and is preferably made from leather, suede or other fabric material. In one embodiment, a first pair of straps 12 comprises a length greater than a second pair of straps 12. In a preferred embodiment, each strap in the first pair of straps 12 comprises a length of approximately 18" and each strap in the second pair of straps 12 comprises a length of approximately 11". However, straps 12 may comprise alternative dimensions. The end of each strap 12 comprises eyelet 32. Laces 14 are coupled to eyelets 32 on straps 12 by a tying member or string member.

Figure 2:
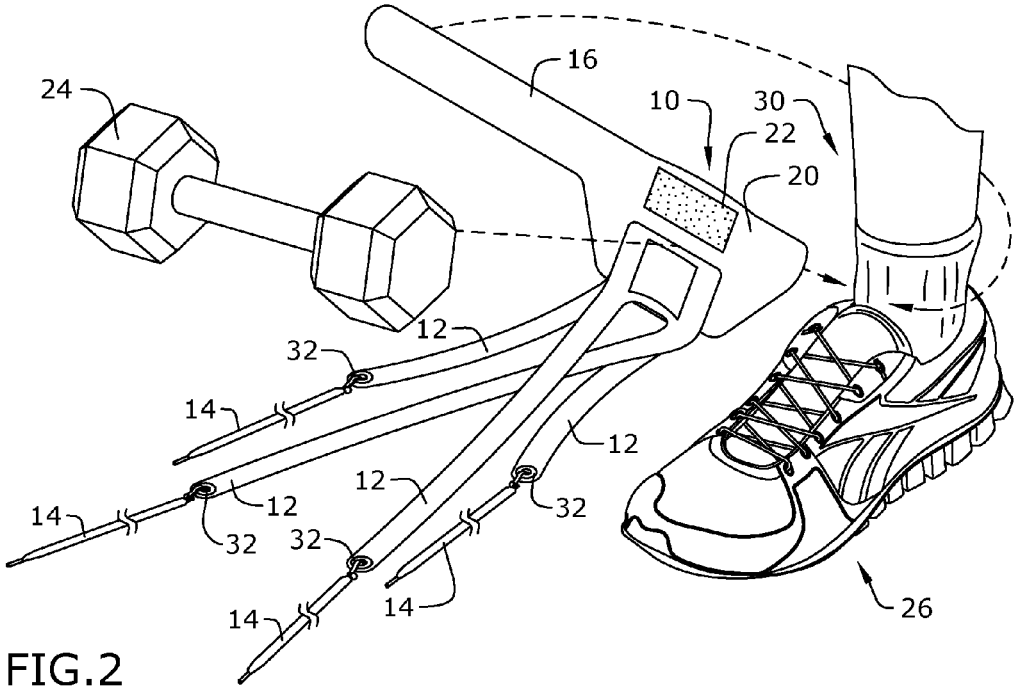
FIG. 2 depicts an exploded view of certain embodiments of the ankle harness.
Figure 3:
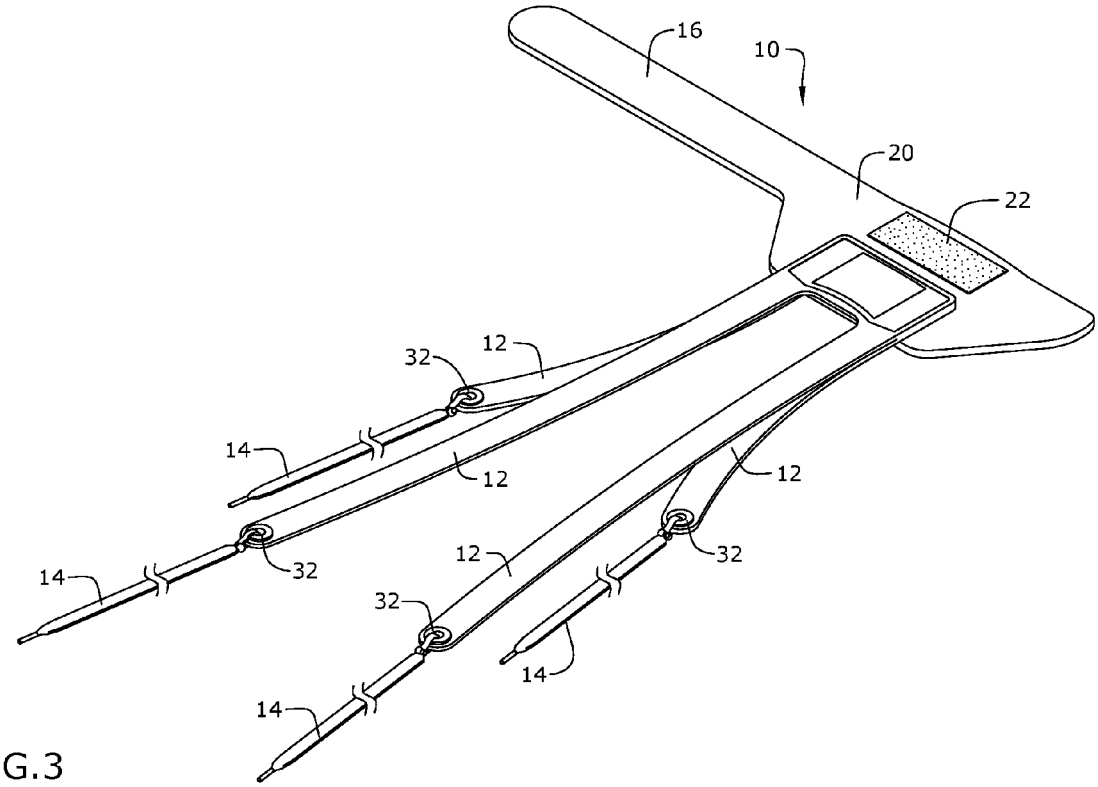
FIG. 3 depicts a top perspective view of certain embodiments of the ankle harness.
Figure 4:
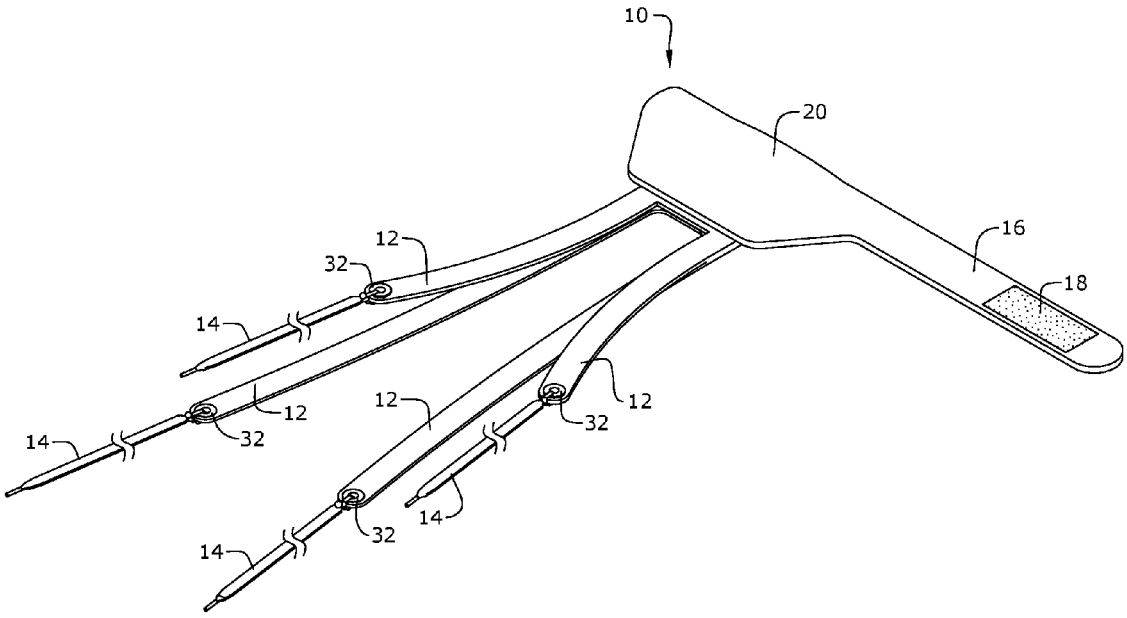
FIG. 4 depicts a bottom perspective view of certain embodiments of the ankle harness.
Figure 5:
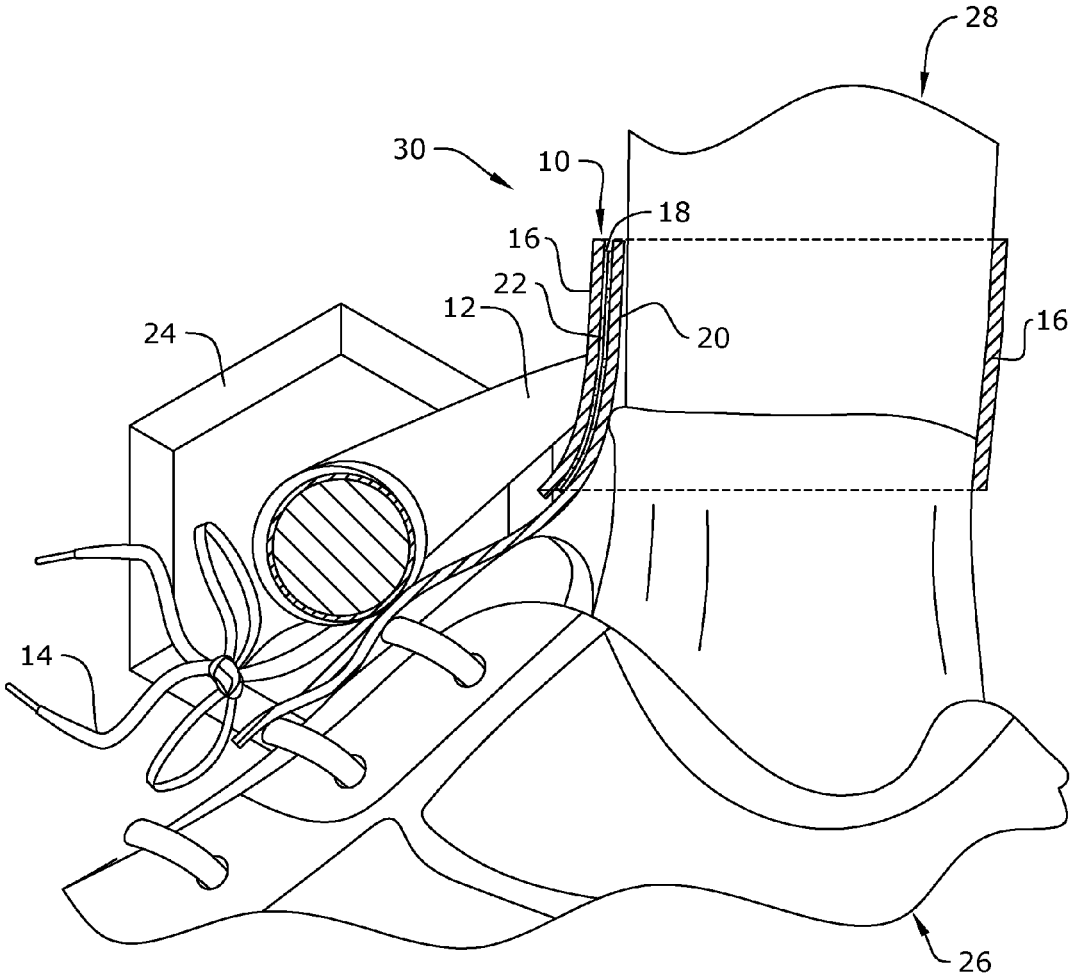
FIG. 5 depicts a section view of certain embodiments of the ankle harness taken along line 5-5 in FIG. 1.

In operation, ankle harness 10 is positioned such that the top face of ankle pad 20 is facing away from ankle region 30 of operator 28 as shown in FIG. 2. As depicted in FIG. 5, ankle strap 16 is wrapped around ankle region 30 until strap fastener 18 engages with pad fastener 22. In this position, ankle pad 20 and ankle strap 16 conform around ankle region 30. Weighted object 24 is placed on operator 28 so that the metal bar of the dumbbell extends across the top of shoe 26. The first pair of straps 12 is preferably wrapped around the metal bar of weighted object 24 and ankle region 30 of operator 28. Laces 14 connected to the first pair of straps 12 are tied together to secure the first pair of straps 12 in place. The second pair of straps 12 is preferably wrapped around the metal bar of weighted object 24 and bottom of shoe 26 as shown in FIG. 1. Laces 14 connected to the second pair of straps 12 are tied together to secure the second pair of straps 12 in place.

In this configuration, operator 28 can perform any variety of lower body and leg exercises with ankle harness 10 and weighted object 24 secured to ankle region 30. The first pair of straps 12 support weighted object 24 such that the weight is not directly applied to the top of shoe 26. The second pair of straps 12 enhances stability of the apparatus and prevents movement of weighted object 24.

It shall be appreciated that the components of ankle harness 10 described in several embodiments herein may comprise any alternative known materials in the field and be of any color, size and/or dimensions. It shall be appreciated that the components of ankle harness 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An ankle harness for securing a free weight to a shoe and an ankle region of a user to permit the user to perform strength exercises, the ankle harness comprising:

a pad member comprising a top face, a bottom face, a top edge, a bottom edge opposite the top edge, and a pair of side edges connecting the top and bottom edges, the top face of the pad member comprising a first fastener coupled thereto;

an ankle strap coupled to one of the pair of side edges and comprising a top face and a bottom face, the bottom face of the ankle strap comprising a second fastener coupled thereto;

a first pair of straps coupled to the pad member and extending past the bottom edge of the pad member; and a second pair of straps coupled to the pad member and extending past the bottom edge of the pad member;

wherein the pad member is configured to be secured to the user by disposing the ankle strap around the ankle region to permit the second fastener of the ankle strap to engage with the first fastener of the pad member, wherein the first pair of straps is configured to wrap around the free weight and ankle portion of the user, wherein the second pair of straps is configured to wrap around the free weight and shoe.

2. The ankle harness of claim 1, wherein each strap in the first pair of straps comprises a first length and each strap in the second pair of straps comprises a second length, wherein the first length is greater than the second length.

3. The ankle harness of claim 2, further comprising a first lace coupled to an end of one of the first pair of straps and a second lace coupled to an end of another one of the first pair of straps, wherein the first and second laces are configured to be tied together to secure the first pair of straps wrapped around the free weight and ankle portion of the user.

4. The ankle harness of claim 3, further comprising a third lace coupled to an end of one of the second pair of straps and a fourth lace coupled to an end of another one of the second pair of straps, wherein the third and fourth laces are configured to be tied together to secure the second pair of straps wrapped around the free weight and shoe.

5. The ankle harness of claim 4, wherein the first lace is coupled to a first eyelet coupled to the end of the one of the first pair of straps and the second lace is coupled to a second eyelet coupled to the end of the another one of the first pair of straps, wherein the third lace is coupled to a third eyelet coupled to the end of the one of the second pair of straps and the fourth lace is coupled to a fourth eyelet coupled to the end of the another one of the second pair of straps.

6. The ankle harness of claim 5, wherein the first and second fasteners comprise hook and loop fasteners.

* * * * *